US011039249B2

(12) United States Patent
Kihm

(10) Patent No.: US 11,039,249 B2
(45) **Date of Patent: *Jun. 15, 2021**

(54) USER-PROGRAMMABLE, HEAD-SUPPORTABLE LISTENING DEVICE WITH WIFI MEDIA PLAYER

(71) Applicant: Douglas P. Kihm, Salt Lake City, UT (US)

(72) Inventor: Douglas P. Kihm, Salt Lake City, UT (US)

( * ) Notice: Subject to any disclaimer, the term of this patent is extended or adjusted under 35 U.S.C. 154(b) by 72 days.

This patent is subject to a terminal disclaimer.

(21) Appl. No.: 16/185,452

(22) Filed: Nov. 9, 2018

(65) Prior Publication Data

US 2019/0082260 A1 Mar. 14, 2019

Related U.S. Application Data

(63) Continuation of application No. 14/266,562, filed on Apr. 30, 2014, now Pat. No. 10,129,649.

(60) Provisional application No. 61/817,635, filed on Apr. 30, 2013.

(51) Int. Cl.
*H04R 5/033* (2006.01)

(52) U.S. Cl.
CPC ..... *H04R 5/0335* (2013.01); *H04R 2201/103* (2013.01); *H04R 2205/022* (2013.01); *H04R 2205/024* (2013.01); *H04R 2420/07* (2013.01)

(58) Field of Classification Search
CPC ..... H04R 5/0335; H04R 2205/024; H04R 2201/103; H04R 2205/022; H04R 2420/07
See application file for complete search history.

(56) References Cited

U.S. PATENT DOCUMENTS 5,125,031 A * 6/1992 Ledonne ..... H04R 1/02 181/161
6,263,085 B1 * 7/2001 Weffer ..... H04R 1/1075 379/430
7,155,025 B1 * 12/2006 Weffer ..... H04R 5/033 381/370
7,292,880 B2 * 11/2007 Lehtonen ..... H04M 1/6066 455/569.1
7,330,553 B2 * 2/2008 Nishiguchi ..... G11C 7/16 381/384
8,897,841 B2 * 11/2014 Haupt ..... H04L 61/00 455/569.1

(Continued)

*Primary Examiner* — Oyesola C Ojo
(74) *Attorney, Agent, or Firm* — Morriss O'Bryant; Compagni Cannon PLLC

(57) ABSTRACT

A user-programmable, head-supportable listening device with built-in WiFi media player is configured to provide user custom application programmability with higher fidelity sound provided by resident audio electronics and conduction speakers, in stereo and HD audio surround sound, the listening device having a user programmable electronics system assembly providing the ability to scan, detect, select and play audio and video from wired and wireless sources of audio and video signals, and from both residential media sources and online streaming music services, an audio media storage device to provide storage of user-selected media for accessing from the listening device or by an external wired and wireless device, which provides the user with control of speakers, wireless interfaces, automatic scanning capability and playing of audio-video media.

9 Claims, 6 Drawing Sheets

(56) References Cited

U.S. PATENT DOCUMENTS

| | | | | |
|---|---|---|---|---|
| 2002/0003889 | A1* | 1/2002 | Fischer | H04R 1/1041 381/370 |
| 2005/0202857 | A1* | 9/2005 | Seshadri | H04M 1/725 455/575.2 |
| 2006/0245598 | A1* | 11/2006 | Batai | H04R 1/1041 381/74 |
| 2009/0274317 | A1* | 11/2009 | Kahn | H04M 1/6066 381/74 |
| 2009/0281809 | A1* | 11/2009 | Reuss | G10L 17/24 704/273 |
| 2011/0103609 | A1* | 5/2011 | Pelland | H04R 5/033 381/74 |
| 2014/0073429 | A1* | 3/2014 | Meneses | H04S 3/004 463/35 |
| 2015/0102983 | A1* | 4/2015 | Serota | H04M 1/05 345/8 |
| 2018/0048750 | A1* | 2/2018 | Hardi | B62D 1/04 |

* cited by examiner

USER-PROGRAMMABLE, HEAD-SUPPORTABLE LISTENING DEVICE WITH WIFI MEDIA PLAYER

CROSS-REFERENCE TO RELATED APPLICATIONS

This is a continuation application claiming priority to non-provisional application Ser. No. 14/266,562, filed Apr. 30, 2014, now issued as U.S. Pat. No. 10,129,629, which claims priority from U.S. Provisional Application Ser. No. 61/817,635, filed Apr. 30, 2013, the entire contents of each of which are incorporated herein by reference.

STATEMENT REGARDING FEDERALLY SPONSORED RESEARCH OR DEVELOPMENT

None.

REFERENCE TO SEQUENCE LISTING, A TABLE, OR A COMPUTER PROGRAM LISTING COMPACT DISC APPENDIX

None.

BACKGROUND OF THE DISCLOSURE

Field of the Disclosure

This disclosure relates to personal devices for the enjoyment of audio entertainment, and specifically relates to autonomous headphone devices that internally incorporate a music player, storage, application and embedded processors and multiple communication interfaces which do not depend on a separate music player to play music or to connect to online media and which are configured to enable accessibility to and enjoyment of audio entertainment from multiple sources, both resident and non-resident to the headphone system

Background of Related Art

There has been rapid growth in the market for high quality surround and sound media, including music, movies, TV and games in both the home and the mobile market. In particular the market for mobile music devices and peripherals, including headphones, has grown especially fast in the past ten years since the advent of mobile digital music players, such as the Apple iPod, combined with the advent of online digital music stores, such as Apple's iTunes.

There are approximately 500 million people worldwide who listen to mobile music using a pair of headphones and a separate music player, such as an iPhone or an iPod. Many people would prefer a simpler, faster and higher quality method of listening to music that may be stored or may be streamed from an online music service without depending on a separate music player. Many people would prefer not to be dependent on or encumbered by a separate music player which may require cumbersome cables, setting up the devices and "pairing" wireless communications. The need to carry a separate bulky player that may deplete the separate smartphone's battery more rapidly and require additional battery management is an additional problem.

With the advent of simple "streaming" of online music radio services, such as Pandora, many people would prefer to simply press a button and instantly listen to a streaming music station without having to connect a cable or pair to a Bluetooth wireless connection, unlock a smartphone, launch an application, select the station and then finally begin to listen to music.

While there has been and continues to be great demand for higher quality multi-channel or surround audio used in Blu-ray movies, there is no headphone being offered in the market that supports Blu-ray movies, video games and TV shows with discrete HDMI compatible 7.1 channel surround HD Audio. In addition the use of surround HD Audio in music has been largely overlooked, in large part, because of the commercial success of mobile stereo music players and online two-channel standard quality stereo music stores. Consequently, in spite of the dramatic improvement in the audio quality offered by multiple channel HD audio surround music, there has been little or no development of any HD audio surround music players or online music stores which offer HD audio surround music.

The general market for all forms of headphones continues to grow rapidly with particularly high growth in the high retail priced "premium" headphones sector. It is estimated that global headphone sales have grown at an annual rate of approximately 20% a year, to approximately $8 billion, in spite of an overall reduction in consumer electronics sales since 2008. It is estimated that U.S. sales of premium stereo headphones ($100+) grew by 25% in units in the first quarter, accounting for 95 percent of the revenue growth for the total U.S. headphone market. A large share of the market growth in headphone sales is currently in mobile two-channel stereo-only music applications which require the use of a separate music player or smartphone.

Currently, there are no means for listening to high definition music that is stored on the headphones, nor is there currently a method for streaming music from an online music service such as Pandora without using a separate smartphone or music player. As a result of these limitations, existing headphone devices either require the use of a cumbersome music player or smartphone, along with either an unwieldy interface cable or an unreliable and complicated wireless interface that requires manual configuration to be able to use conventional headphone devices. Further, additional separate external devices are required to support high definition audio such as 96 kHz/24 bit rates, high wattage amplification, surround sound or other special effects, including spatial virtualization.

Existing headphone devices, without the use of a separate device, cannot autonomously process two-channel audio, such as music, for example, and cannot convert the two-channel sound into virtual surround sound in real time, and then drive the surround sound via more than two speakers. For example, it is not possible using an existing headphone device to watch and listen to a 7.1 channel HD Blu-ray movie with its original master studio quality 7.1 channels of HD Audio format via a set of discrete 7.1 channel speakers. Existing headphone devices are limited in their media compatibility, media source player interface capability, the number of speakers, their lack of an integrated HD audio surround sound media player, and are limited in the audio quality they deliver since they are dependent on the quality of the external separate music player's Digital to Analog Converter (DAC), audio amplifier quality and the quality of service provided by the communication interface they use. No existing headphone device offers the ability to stream or transfer music and other media files over WIFI communication interface and, thus, conventional devices are relegated to use an inferior communication interface which, in comparison to WIFI, is limited in available bandwidth and can experience data loss and latencies, which results in poor, transmitted audio quality.

Existing devices are also not capable of being converted from use as on-head based headphones to off-head, desktop or shoulder based open air speakers. Existing devices also do not offer elements, such as a surface conduction vibration speaker, that deliver audio frequencies and amplitudes that allow the listener to feel the vibration of the sound being transmitted through the headphones with little or no pressure being applied to the listener's head and ears, which dramatically improves comfort and ergonomics in comparison to using low wattage dynamic speakers.

BRIEF SUMMARY OF THE DISCLOSURE

In accordance with one aspect of the disclosure, a head-supportable audio player and listening device is comprised of two housings structured to be supportable on or about a portion of a user's head, each housing being structured for positioning relative to the user's ears to transmit audio to the auditory canals of the user, a linking device attached to each of the two housings structured to link one housing to the other housing, a plurality of speakers positioned within each of the two housings, the plurality of speakers being configured to provide both stereo and high definition surround sound audio, a user-programmable electronics system assembly positioned on one or both of the housings or on the linking device, further comprising multiple wireless interfaces configured to provide wireless connectivity of the listening device to wireless-emitting sources, a media storage device configured to provide storage of user-selected digital files for accessing from the listening device and having programmable functions providing the user with control of the speakers, wireless interfaces and the audio media storage device. This aspect of the disclosure provides unique and multiple functions in a head supported audio device that allows the user greater access to and control of audio media entertainment.

In one embodiment of the disclosure, the user-programmable electronics system assembly further includes a programmable application processor configured to run an industry-standard operating system.

In other embodiments, the user-programmable electronics system assembly further includes digital signal processors and ADC and DAC audio converters for voice recognition and synthesis.

In certain embodiments, the user-programmable electronics system assembly further includes a control system comprising one or more of a keypad, touch screen, touch display, system display indicators and volume control device.

In some embodiments, the user-programmable electronics system assembly further includes battery apparatus configured for charging the listening device.

In still other embodiments, the listening device of the disclosure further comprises a microphone device positioned in proximity to either of the two housings or the linking device.

In certain embodiments, the plurality of speakers numbers between two and ten, each housing being structured to retain from one to five speakers per housing.

In yet other embodiments, each of the two housings is structured to include a surface conduction transducer for providing vibration of the associated housing.

In still other embodiments, the user-programmable electronics system is configured to provide automatic scanning capability for selective accessing of audio signals from multiple wired audio sources, including analog and digital devices, via high definition multimedia interfaces, digital media interfaces or pre-amp analog sources.

In other embodiments, the automatic scanning capability is configured to automatically scan for and selectively access audio signals from multiple wireless audio sources, including WiFi or cellular-enabled online music services and online or cloud music storage services.

In certain embodiments, the user-programmable electronics system assembly further includes NFC electronics or equivalent apparatus.

In yet other embodiments, the user-programmable electronics system assembly is further configured to access and transfer video files, and is capable of storing video files in a media storage device that is part of the user-programmable electronics system assembly.

In some embodiments, the user-programmable electronics system assembly is configured to enable the user to selectively browse, search, select, connect and manage the storage and playback of audio-video files from the storage device.

In still other embodiments, the user-programmable electronics system assembly is configured to enable the user to selectively browse, search, select, connect and manage the storage and playback of audio sound files from the storage device.

In certain embodiments, the user-programmable electronics system assembly is further configured to receive and transmit signals to and from an external control device for enabling remote user control and programming through the user-programmable electronics system assembly.

In other embodiments, the two housings are removably connected to the linking device.

In still other embodiments, the user-programmable electronics system assembly is further configured to enable the user to schedule the recording of subscribed music via an online music service for later time-shifted listening when the listening device is out of WIFI or cellular Internet accessible range.

In yet other embodiments, the user-programmable electronics system assembly is further configured to acquire, monitor and store to the user-programmable electronics system, or to a remote device in communication with the user-programmable electronics system assembly, information comprising the heart rate, body temperature and expended calories of a user wearing the listening device.

The head-supportable listening devices of the disclosure are typically an Android, Linux or iOS-based device that provides accessibility to wireless connectivity, while providing other features, such as HD (high-definition) audio. The use of an Android, Linux or iOS operating system enables the use of a multitude of custom and existing applications (also referred to herein as "apps") and both local and web-based services on the listening device that may easily be added by the user to customize the listening device to his or her personal applications and preferences.

The listening device is configured to provide multi-sourced capabilities, including WiFi connected online web services such as Pandora streaming music service, and other web media services, smartphone WiFi and Bluetooth connectivity which provides access to both telephony services and media steaming capabilities from any number or type of external music-playing and storage devices, mobile devices, television, gaming devices, home receiver devices, network attached storage devices or other smart wireless media devices.

The listening devices of the disclosure may be configured by the user to play music and other audio services directly from the web and cloud-based services via its integrated WiFi communication interface or via an integrated cellular phone network interface. The listening devices may optionally access the cellular phone network by tethering to the cellular phone network via the WiFi hotspot service of a smartphone.

The listening device can play virtually any web-based streaming audio service plus streaming video service when connected to an external display by its integrated HDMI video interface connection. The listening device can directly stream web-based streaming music services such as Pandora, Spotify, Google Play, Beats Music, Rdio and many other music and radio services. The listening devices can also play streaming audio podcasts, audiobooks, vocalized news and weather reports, digital voice mail, vocalized text messaging, vocalized e-mail and other streaming social media.

The listening devices of the disclosure support the integrated and external playback, communication and control of both stereo and surround music, movies, games, TV shows and other media applications in both residential and mobile applications. The devices of the disclosure provide unique methods that allow for the private listening of audio from both mobile and residential media sources, stereo music, 7.1 multi-channel surround music and two-channel stereo music that is virtualized into multi-channel surround music.

The devices of the disclosure uniquely combine in one device up to ten discrete speakers with an integrated surround sound music player that can play both source surround music and two-channels of stereo music that is converted into virtual surround sound. In addition the devices enable the user to listen to discrete master studio quality 7.1 HD Audio Blu-ray movies, games and TV shows in their original audio format, including audio formats such as 7.1 DTS HD-Master or 7.1 Dolby TrueHD. The devices of the disclosure enable the discrete playing of HD Audio quality surround sound from sources of audio via HD quality interfaces such as HDMI.

The listening devices of the present disclosure can be used to autonomously play music without being dependent on any other separate external media playing device through the incorporation of a media player with memory and a communication system. The configuration of the devices eliminate certain limitations in existing audio units that require the use of a cumbersome interface cable or an unreliable and complicated wireless interface in order to use the device.

The listening devices of the disclosure incorporate multi-channel, multi-speaker headphones or similar auditory-engaging apparatus which can include ten discrete speakers that deliver uncompromised, 7.1 channels of master studio quality HD Audio with minimal quality degradation. Use of ten individual speakers, for example, results in audio quality that is crisper, more discrete and generally of higher quality, with a broader dynamic range and louder amplification with minimal noise than conventional two-speaker based stereo headphones. The devices of the disclosure support multiple channels of high definition audio that are stored with higher frequency digital sample rates and bits per sample rates, which results in the ability to deliver digital audio with up to eighteen times the bit rate quality than standard audio stereo music files.

The listening devices of the disclosure incorporate music player electronics which allow the listening device to be used autonomously without the need of a separate media player device. The listener can simply transfer the music files onto the listening device and, without the use of any other electronics, such as a portable music player or smartphone, listen to the music anywhere and at any time. The listening devices of the disclosure incorporate electronics that allow for the playback of music files that are located externally on a media player, such as a Blu-ray player, or can directly connect to an online downloadable or streaming music source from the Internet. The listening device of the disclosure plays HD Audio media from many different external media players both wired and wirelessly, such as a Blu-ray player via its HDMI, SPDIF and pre-amp analog inputs or from a network attached storage device via WiFi.

The listening devices of the disclosure play back a wide variety of HD Audio formats of music, movies, games, TV shows and other media applications, which results in making the listening device compatible with both stereo and HD audio media players. For example, while conventional headphones are limited to two-channel stereo formats, such as MP3 or other two-channel source formats, the present listening devices of the disclosure are capable of directly decoding virtually any 7.1 multi-channel HD Audio format, including DTS HD-Master Audio, Dolby TrueHD and Linear Pulse Coded Modulation (LPCM) audio. This results in a fuller and dramatically enhanced audio experience.

The listening devices of the disclosure are configured to provide for the transfer of files to its onboard memory storage via several different types of interfaces including USB, Bluetooth and WiFi. Also, the listening devices of the disclosure are configured to provide for access to unique multimedia formats that play a variety of media, including digitally protected surround sound music, music videos and movies when connected via its HDMI interface to an external display.

The devices of the disclosure provide unique methods of digitally controlling multiple individual channels of audio volume by both internal and external manual dials, and programmatically via an external computer based remote, both at the digital media player pre-amp stage and at the output amplifier stage.

The listening devices of the disclosure are uniquely configured with a surface conduction transducer, or vibration transducer, that enables the listening device to be used off or away from the user's head, while still providing sound transmission to the user. That is, the surface conduction transducer facilitates greater sound pressure levels and higher quality sound production when the listening device is positioned on the head and in proximity to the user's ears; but the surface conduction transducer also enables the listening device to be placed on, for example, a table and still be heard by the user when positioned off the head.

The listening device of the disclosure is further configured to address a common problem with excessive pressure that is applied by conventional headphones when positioned on the user's ears and head because the speakers of conventional headphones are, on average, 50 mwatt and need to have a perfectly tight pressure coupling between the speaker cavity and the listener's ear. The listening device of the disclosure solves this problem by utilizing surface conduction transducers that vibrate the housing or housings of the device with twenty times more wattage than conventional speakers with one watt or higher transducers and radiates these sound waves in an acoustical energy efficient manner through the housing, resulting in dramatically higher volumes and dynamic ranges than traditional headphones. This ultimately results in dramatically improving the listeners comfort and entertainment experience due to less pressure and heat since it eliminates the need to apply excessive pressure to the listener's ears and head while achieving equal or dramatically improved sound quality.

These and other structures and advantages of the listening devices of the disclosure will be understood with further consideration of the accompanying drawings and description of the illustrated embodiments set forth hereinafter.

BRIEF DESCRIPTION OF THE SEVERAL VIEWS OF THE DRAWINGS

In the drawings, which depict what is currently considered to be the best mode of the invention.

DETAILED DESCRIPTION OF THE DISCLOSURE

Figure 1:
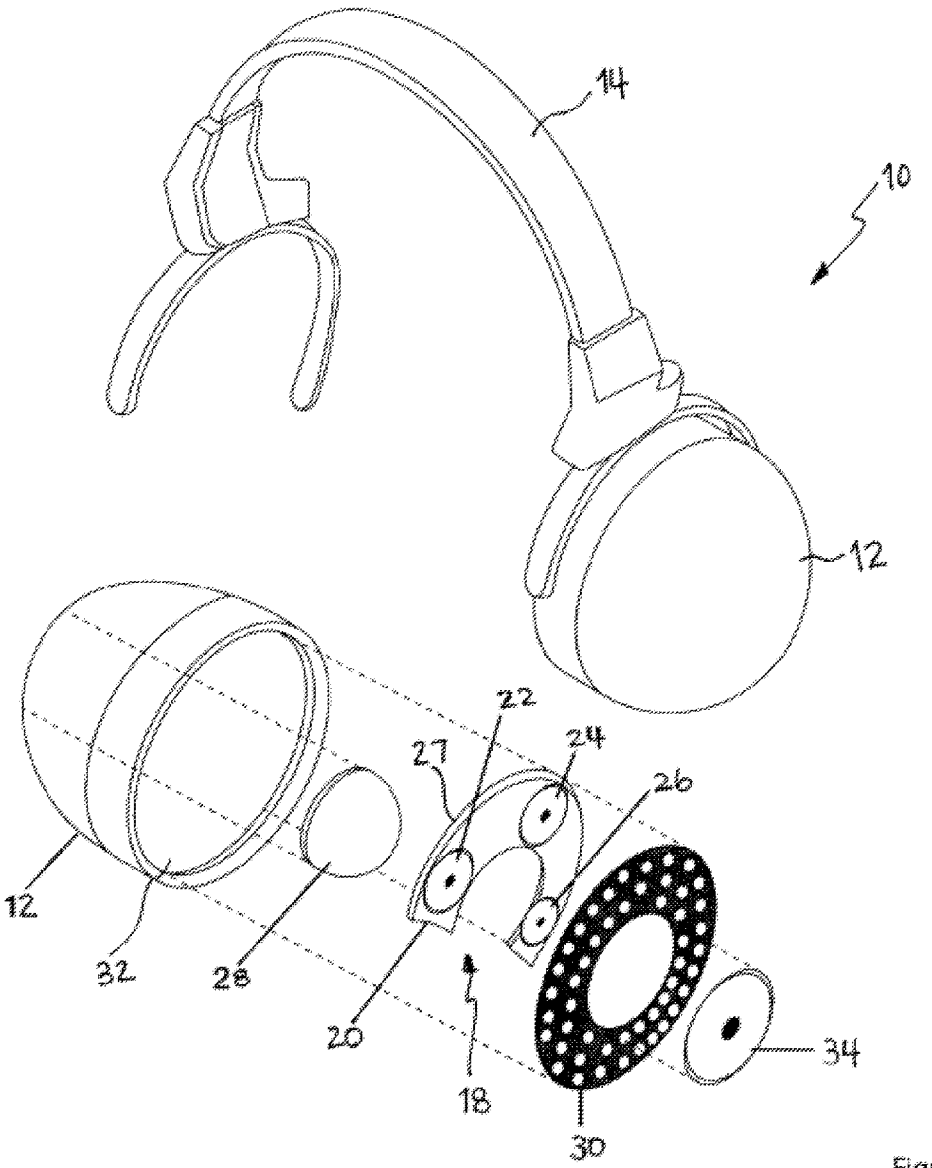
FIG. 1 illustrates schematically a first aspect of the disclosure where a headphone device is shown in partial exploded view.

FIG. 1 illustrates schematically the general structural elements of the head-supportable listening device 10 of the disclosure. As used herein, "head-supportable listening device" is meant to include any device of any configuration that can be supported on or by the head, or supported on or by any portion of the head, including the ears, and which is configured to provide an element or elements that direct an audible signal, sound or stream into or toward the user's auditory canal or auditory canals. Thus, while the listening device is illustrated herein as a headphone or headset device for ease of illustration, it is to be understood that the listening device can be configured in other forms, such as ear buds or equivalent devices.

In FIG. 1, the listening device 10 generally comprises two housings 12 structured to be supportable on or about a portion of a user's head. Each housing 12 is structured for positioning relative to the user's ears to transmit audio to the auditory canals of the user. The listening device 10 further comprises a linking device 14 attached to each of the two housings 12. The linking device 14 is structured to link one housing 12 to the other housing 12.

As shown in FIG. 1, each housing 12 may be connected to the linking device 14 in a manner that allows the housing 12 to be selectively separated from the linking device 14. The primary advantage of this construction is to allow the listening device to be configured in a manner that allows the housings to act as open air speakers when a high wattage vibration speaker 28 is used in the housing. The user can listen to the music without placing the listening device on the user's ears. This arrangement accommodates applications where, for example, the user would like to listen to music when the listening device is placed off the ears, such as being placed on the user's shoulders or placed on a table.

FIG. 1 illustrates with respect to one of the housings 12 a number of the operational elements that are included in the housing 12. It will be understood that the elements described and illustrated as being in one of the housings are generally found in both housings 12, although only one housing is shown in an exploded view. Generally, the housing 12 is sized and structured to retain therein a plurality of speakers 18 that provide sound to the user. The individual speakers 20 of the plurality of speakers 18 may take the form of transducers or other equivalent devices.

Transducers that may be used in the listening device 10 may include traditional dynamic speakers that employ a diaphragm and a coil to convert electrical signals and energy into kinetic, acoustical energy by moving air at the frequency and amplitude defined by the analog electrical signal. The speakers 20 may include a surround speaker 22, a center speaker 24, a rear speaker 26 and a front speaker 34. In most multi-channel embodiments that support greater than two speakers, dynamic speakers are used for the lower powered channels including the front speaker 34, rear speaker 26 and the surround speaker 22 channels, while vibration speakers are used for the sub-woofer, and in both multi-channel and two-speaker stereo applications, the front speakers.

Another transducer that may be employed in the device 10 is a surface conductive or vibration speaker 28 which converts an analog signal and energy into kinetic, acoustical energy by directing the mechanical force of an electromagnetic solenoid into the surface of the housing. The housing 12 then acts as an acoustical radiator which transfers the surface-radiating sound wave throughout the entire surface of the housing 12 and exits out of the housing through a dampening acoustical filter 30 composed, for example, of a fabric that reduces extraneous high frequencies, into the listener's ear. The wattage and resulting sound pressure level delivers a more energy efficient sound wave that dramatically reduces the need to directly couple the transducer to the listener's ear cavity, and results in superior sound and comfort.

The plurality of speakers 18 are positioned to surround a baffle member 27 that directs the sound waves in the most acoustical, energy efficient manner, and reduces the creation of interfering sound waves that can result in cancellation of sound energy. While one baffle 27 is shown, more than one baffle may be used. This arrangement and use of strategically positioned baffles results in the highest quality, clearest and greatest dynamic range of sound. The baffles 27 may also function as a resonator plate which most effectively recreates the full dynamic range and spatial sound of floor-based speakers.

The number of speakers 20 that are employed in the listening device 10 may be greater than two, which is the typical number of speakers used in traditional headphones to produce audio from a two-channel system. The number of speakers 20 employed in the present device may be from two to ten, or greater. In a preferred embodiment, the number of speakers per housing may be from two to five in number.

Figure 2:
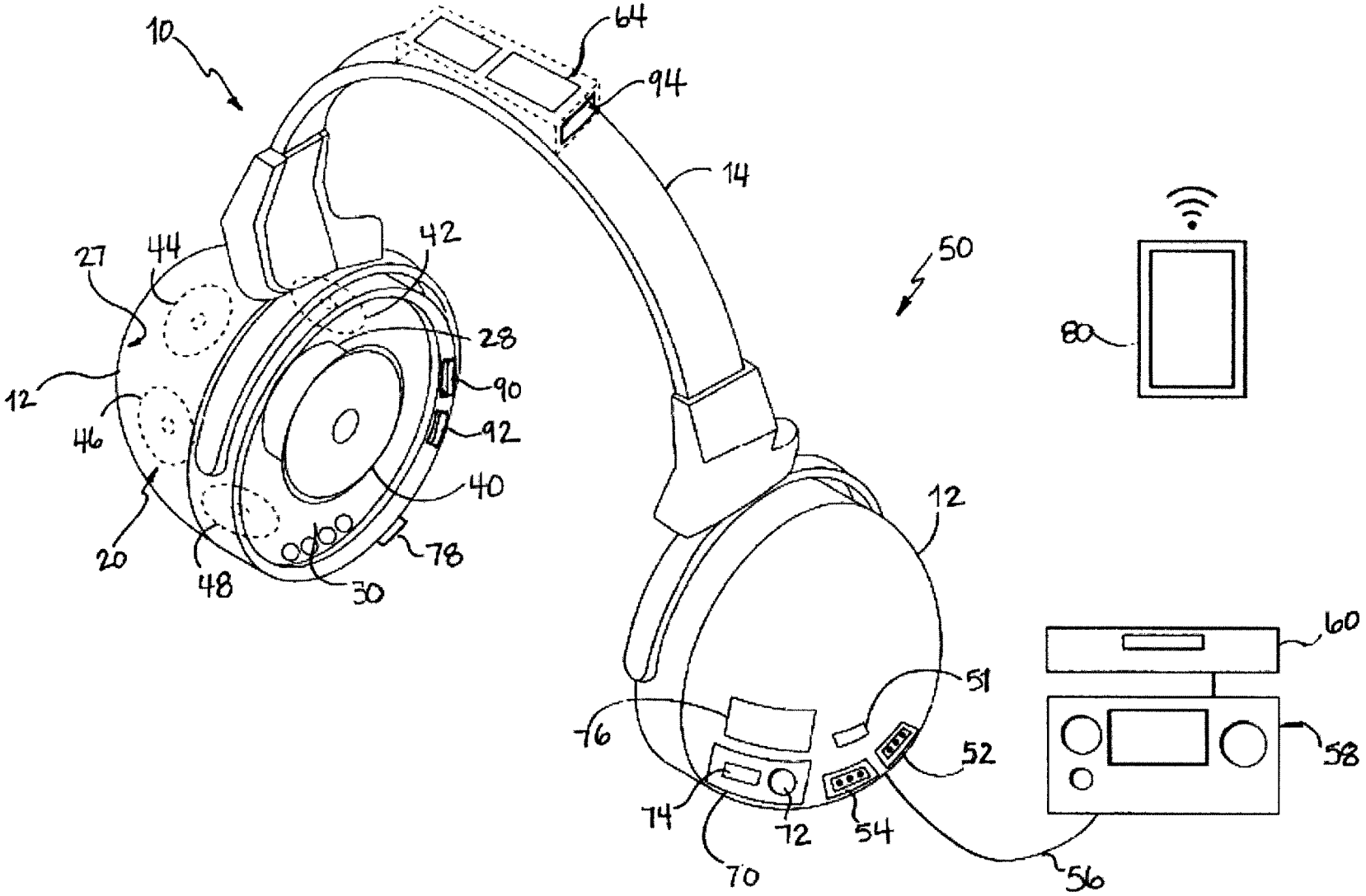
FIG. 2 illustrates schematically a further aspect of the disclosure.

FIG. 2 illustrates in further detail the various components that may be associated with the listening device 10. In this embodiment, the number of speakers 20 employed is five, including a front speaker 40, a center speaker 42, a sub-woofer speaker 44, a rear speaker 46 and a surround speaker 48. The speakers 20 are positioned within the housing in a spaced arrangement and are positioned in proximity to a baffle 27. The opening of 32 of the housing is covered by an acoustical filter 30.

The listening device 10 further includes a user-programmable electronics system assembly, generally represented by reference numeral 50, which comprises the electronic hardware and software elements which provide the multiple functions and user programmability of the listening device, as described more fully below. The user-programmable electronics system assembly may be positioned on one or both of the housings 12 and/or on the linking device 14.

The user-programmable electronics system assembly 50 comprises multiple wireless interfaces configured to provide wireless connectivity of the listening device to wireless-emitting sources. In one particularly suitable embodiment, the user-programmable electronics system assembly 50 may comprise at least two wireless interfaces, schematically depicted as 51. The wireless interfaces 51 enable wireless connectivity of the listening device to wireless-emitting sources, including Bluetooth and WiFi. Such connectivity allows the listening device to access any number of audio media, such as music files, from a wireless mobile device, from a computer, from a television, and from any number of various sources.

The wireless interfaces 51 are comprised of device drivers and application software to which other applications and the operating system software interface with the associated hardware devices. Respective antennae are included to transmit the digital signal wirelessly to and from a compatible wireless device such as a WiFi network router or WiFi- or Bluetooth-enabled smartphone.

The user-programmable electronics system assembly 50 further includes a media storage device 52 configured to provide storage of user-selected digital files for accessing from the listening device 10. The media storage device 52 is configured to store audio files, and may also be configured to store video media files. The media storage device 52 provides non-volatile memory storage for audio and video files. The media storage device 52 typically includes at least 4 GB of internal storage with a provision to add additional external removable storage via a micro SD memory card slot that is accessible by the user. The micro SD memory card slot may accept a minimum of 32 GBs of additional media storage.

The media storage device 52 enables the user to selectively store, in residence on the listening device 10, and to access, user-selected data files such as music, videos such as a movie, and audiobooks or audio podcasts. The media storage device 52 in configured with software for accessing upon command from the listening device 10 those data files that the user wishes to listen to. Media files may be stored, removed or accessed via both wireless communication interfaces such as WiFi and hardwired connections such as USB.

The user-programmable electronics system assembly 50 is also configured to provide programmable functions providing the user with control of the speakers 20, wireless interfaces 51 and the media storage device 52. The programmable functions include the capability of the user-programmable electronics system assembly 50 to automatically scan, using auto scanning software that is configured for automatically scanning, detecting and selecting wired and wireless audio sources by reading the prioritized user defined list of WiFi hotspots or routers, Bluetooth communication devices and wired audio devices. The auto scanning software circumvents the operating system and takes direct control of the associated wireless communication and wired audio interfaces to provide the listener the simplest, automated method of locating, selecting, connecting and playing from either the highest priority source, as defined by the user's predefined list of communication and audio devices, or a manually user-toggled and selected communication and audio device.

The user-programmable electronics system assembly 50 includes Near Field Communication (NFC) electronics and software that allows the user to wirelessly acquire the data files or information necessary to immediately connect to a smart NFC enabled media device such as a smartphone.

The listening device 10, through the use of a custom application software routine as part of the user-programmable electronics system assembly 50, provides the user the ability to schedule the recording of subscribed music on an online music service for later "time shifted" listening when the user is out of WIFI or cellular Internet-accessible range. The "stream shifting" software utility is designed to meet the copyright requirements of sponsored online streaming music services by incorporating digital rights management software which only allows paid subscribers of the music service to listen to the recorded music one time, and prevents permanent storage of the recorded music. The software may be adapted to meet the specific online music service's digital rights management needs.

The user-programmable electronics system assembly 50 includes multiple processors, namely the application processor that runs on an operating system such as Android or iOS, and one or more embedded dedicated processors that perform functions such as USB data stream conversion, keypad interfacing, touch display panel interfacing, battery charging and status management. A Digital Signal Processing or DSP processor may be included where additional DSP may be performed. The DSP processing may include equalization and audio format conversion which is performed, for example, where a stereo two-channel audio file can be converted in real time to virtualized, 7.1 channels of streaming surround sound audio, the Digital to Analog Converter or DAC where the digital stream is converted into an analog signal with audio bit rate and depth resolutions, such as 44 kHz/16 bits or 96 kHz/24 bits which exceed commercial music players and smartphones plus and an audio pre-amp and high powered audio output stage amplifier. The processors may also include ADC devices.

Another unique application of the listening device's DSP section is to perform three dimensional (3D) spatialization of the audio based on the position of the listener's head in relation to the room or to the display on which the user is watching a movie. By using the system electronics assembly-based motion detector, the movement of the listener's head can be tracked and the DSP can convert, in real time, the virtualized direction and location of the sound being heard by the listener, which results in producing the perception that the source of the sounds are emanating not from the listening device itself but from a source located outside and away from the listening device. Because this set of digital and analog audio electronics is programmatically controlled by the user-programmable electronics system assembly 50 application software and processor, the use of the listening device is fully adaptable and dynamically reconfigurable to any given application and audio source, whether the source is an online streaming music service, a Bluetooth transmitted movie from a home audio video receiver or from multi-channel HD audio music stored in the listening devices onboard memory storage.

The user-programmable electronics system assembly 50 may also include external interfaces 54 that enable an external device to be directly connected or hardwired to the listening device 10. Hardwired connections can include analog audio outputs to connect to external speakers, analog audio inputs for devices such as an external microphone, a digital audio input, including an SPDIF connector for connecting to a game console, and HDMI audio/video input and output connectors that can accept either 7.1 multi-channel HD audio in or send 7.1 HD audio and video out to an external display respectfully. A USB connector additionally provides a method to transfer media files, including music and videos, onto and off the listening device from an externally connected USB compatible computer. For example, the user-programmable electronics system assembly 50 may be configured with an external interface 54 that enables a wired cable 56 to extend from a media player 58, such as a home audio-video receiver, computer and/or Blue-ray movie player device 60 that is connected via the media player device 60 and directly hardwired connected to the listening device 10. Notably, the enhanced sound, in both two-channel and 7.1 channel HD audio surround sound, that is provided by the speaker array 18 of the present device provides more high definition sound from such external media players and devices than is available in conventional arrangements.

The user-programmable electronics system assembly 50 further includes means provided on or within the listening device 10 by which the user is provided with selective control and manipulation of the various functions of the device 10. For example, the user-programmable electronics system assembly 50 may include control apparatus 72 for controlling volume. The user-programmable electronics system assembly 50 may also include resident software and hardware for selectively controlling and programming the wireless interfaces, automatic scanning system and media storage device.

The user-programmable electronics system assembly 50 also comprises a control system, generally at 70, that further comprises a touch sensitive display 74 to provide a method for the user to search for a specific media file by the genre, artist or title and for advising the user of, for example, the source of the media, the audio or video file currently being played, the status of battery life, among other functions. The control system 70 may also include a keypad 76, a touch screen, touch display or other system display indicators and volume control device, such as control knob 72.

A microphone 78 may be included in the listening device 10 which the user may use, through the various interfaces, to conduct telephonic communications or provide voice commands to the user-programmable electronics system assembly 50. Since the user-programmable electronics system assembly 50 includes both analog to digital converters (ADC) for digitizing analog microphone voice recognition and digital to analog converters for generating voice synthesis, DSP electronics and firmware for processing the vocal data plus a programmable applications processor based on a well-established operating system such as Android, iOS or Linux and open application software standards, voice recognition and synthesized control of system and user applications are fully implementable utilizing existing resident hardware. The user-programmable electronics system assembly 50 may be programmed in a way that allows the user to mute the audio being played through the speakers and turn up the microphone 78 so as to allow the user to hear external sounds, such as someone speaking, without having to remove the listening device.

An external remote control device 80 such, as a smartphone or custom home control system, may also be used to control and stream audio over WiFi to the listening device 10. The external remote control device 80, in conjunction with a custom software application, for example, may provide remote searching, browsing, playback and playback control of music and other media, both stored locally on the listening device or being streamed from the control device 80 or other media storage location, including from an online media storage service. One example is using the external remote control device to allow the user to search, browse and stream to the listening device 44 kHz/16 bit CD quality music that is stored on a server that is located on the Internet, such as Google Drive. The external remote control device 80 also provides many other functions, including transport control of media being played, such as stop, skip and fast forward, adjusting the volume and EQ, virtual sound and other DSP audio mode selection, system status including available media storage memory and battery status, plus utilities that allow the user to easily transfer files to and from the listening devices resident memory storage. Other remote functions are within the scope of the disclosure.

The listening device of the disclosure may further be configured with biological sensors that, when combined with a custom software application running on the listening device 10, and optionally on a smartphone, allow the real-time monitoring of the user's heart rate, body temperature, calories being burned and other health-related information for the purpose of tracking the user's health condition, especially when the user is exercising while using the listening device 10. As shown in FIG. 2, a pressure sensor 90 and temperature sensor 92 may be located on the listening device 10, for example, on the housing 12 such that when placed on the user's head, the housing 12 positions the sensors directly in contact with the user's ear, especially at the periphery of the user's ear, where the sensors can acquire the heart beat and body temperature data.

An accelerometer sensor 94 that is located inside one or more of the housings 12 or the linking device 14, illustrated in FIG. 2 as being connected to the linking device 14, acquires movement data of the user so as to calculate the estimated calories being expended. The user may either review both real time and stored health data via both the resident touch display 74 or from a smart controller device that is running custom application software to communicate with the listening device 10 over WIFI or Bluetooth communication interfaces. Because the listening device includes full duplex, two-way WIFI communications, the user is able to both monitor and transfer to the smartphone, in real time, all health data being collected while at the same time controlling the media player 52 of the listening device, as well as controlling other functions. Additionally because the listening device 10 is configured as an Internet-connected device, the listening device 10 can also store the health data onto a web-based storage server that can be accessed and analyzed at any time by the user's Internet-connected personal computer.

Figure 3:
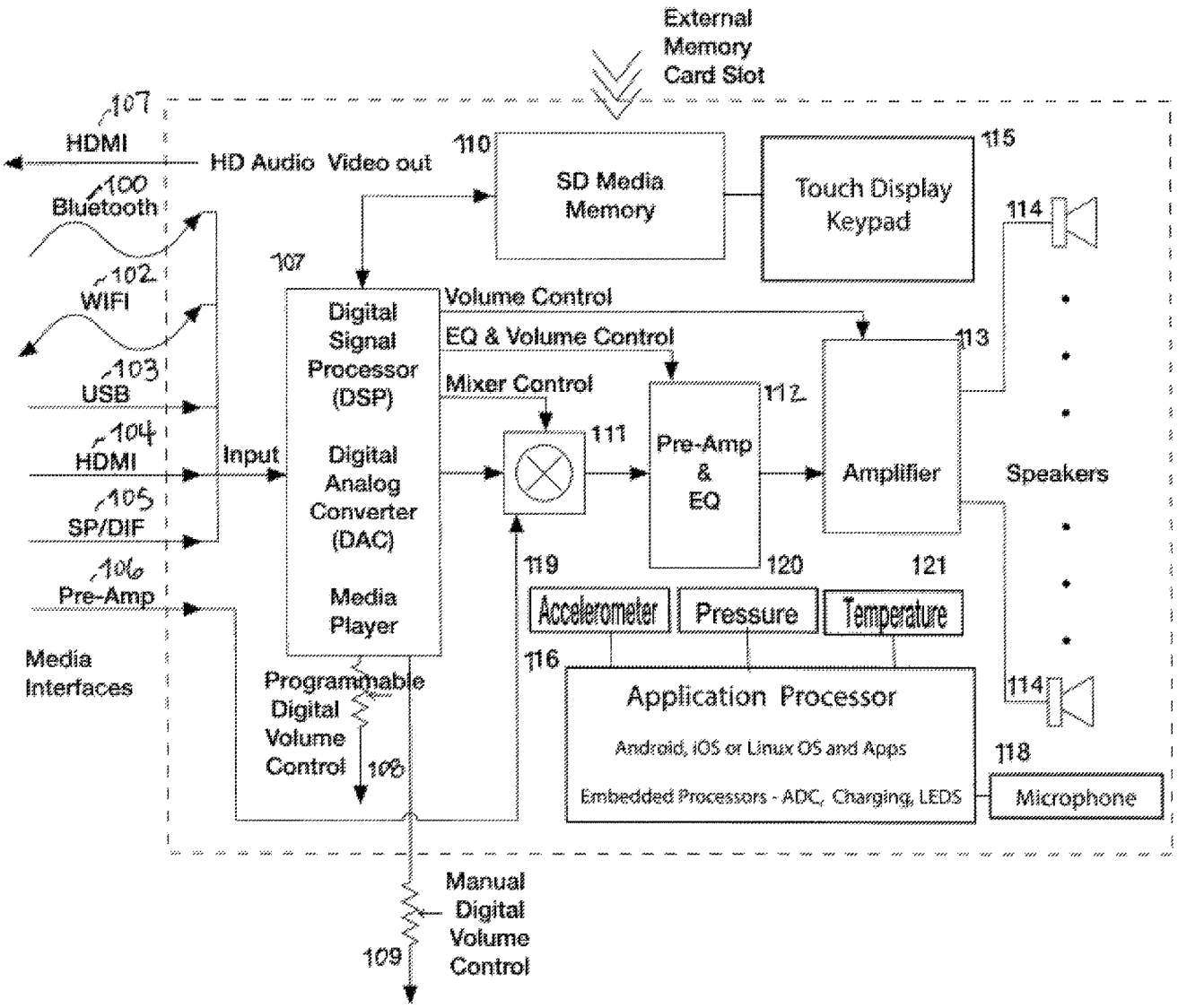
FIG. 3 depicts various operative modes of the disclosure.

FIG. 3 diagrammatically illustrates certain functionalities of the listening device 10. As illustrated, the listening device may have multiple media interfaces, including Bluetooth 100, WIFI 102, USB connectivity 103, HDMI 104, SP/DIF 105 and Pre-Amp 106, and may include an additional HDMI interface 117. These interfaces provide both wired and wireless communication and media interfaces to the listening device. The DSP, DAC, volume control, mixing control, EQ control and other audio-video electronic functions are depicted at 107. The audio-video electronics 107 interface with embedded and application processors to give application software applications the ability to control and customize the functions of the audio-video electronics.

The programmable volume control 108 and the manual volume control 109 interface to the audio-video electronic functions 107. The SD memory card assembly 110 provides user-accessible and upgradeable media memory. The multiple channel audio mixer 111 mixes analog audio signals and drives the pre-amplifier 112 which in turn drives the output stage amplifier 113 that sources the output speakers 114. The speakers 114 may vary in quantity from two to ten including two or four surface conduction speakers. The touch display panel 115 allows the user to browse and control the playback of media plus many other system functions.

The application processor 116 runs the user-programmable electronics system assembly, in general, including device drivers and associated applications, while the embedded dedicated function processors 116 interface the touch display panel, keypads, charging control, LEDs and other system functions. The HDMI HD audio-video output 117 is driven by the application processor 116 and can drive an external display including head-supportable displays to render videos, movies and other audio-video media that is being played by the media play of the listening device. In addition, the HDMI output provides an optional way to access, customize and configure the systems settings and applications. The microphone 118 may consist of one or more microphones to support voice recognition, external audio mixing and noise cancellation.

Additionally, the accelerometer 116, the pressure sensor 120 and the temperature sensor 121 are in communication with the application processor 116, which provides software applications and operative functionality to the sensors.

Figure 4:
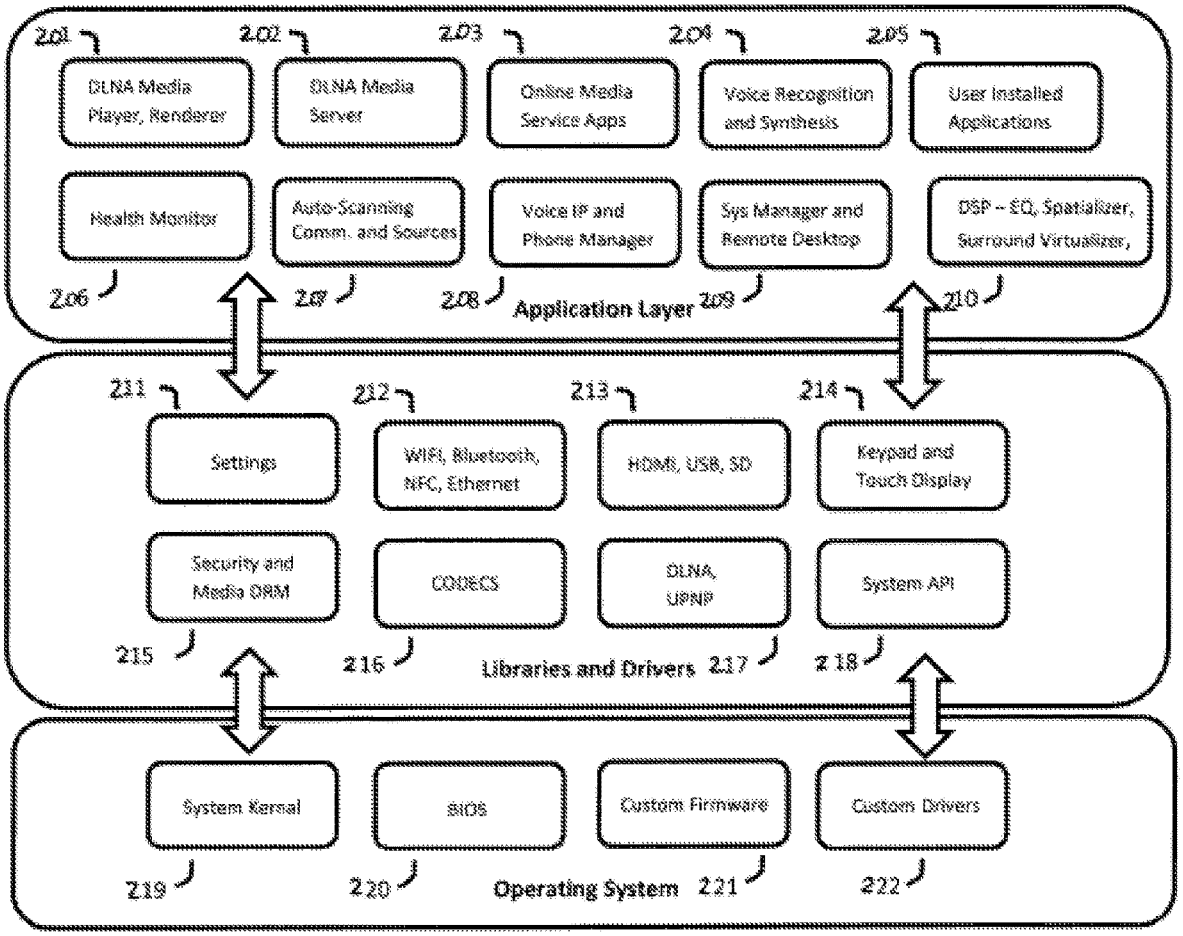
FIG. 4 is a flow diagram depicting the software components and applications that form a part of the disclosure.

FIG. 4 illustrates in further detail the software components that are configured to provide functionality to the listening device. There are three main sections namely the Application Layer, the Libraries and Drivers, plus the Operating System. The Application Layer is comprised of both standard applications or "apps" that are included with the listening device and user installed apps that are obtained from an online app store, such as those found on a Google™, Android™, or Apple™ iOS app store.

Standard apps include a DLNA media player and renderer 201 that plays media, including music and videos, from various sources, including locally stored media, media stored on a DLNA-compatible network-attached storage device or on an online storage server such as Google Drive. The player 201 may also act as a renderer which allows the user to install a DLNA player app onto a remote networked computer or smartphone, then browse, select and stream media store, for example, on the smartphone, to the renderer 201, which then plays the media. The remote player app can also select media stored on the listening device by browsing the media that is made available by the DLNA Media Server 202.

One or more online media apps 203, such as Pandora™ and Spotify™ online music service apps, are examples of the many apps that may be included with the listening device for implementation of the varying functions described herein. A voice recognition and synthesis application 204 is included which provides the ability to vocally search, select and control the playback of media.

A health monitor application 206 may be included which, in conjunction with the listening devices user-programmable electronics system assembly and associated sensors, allows the user to monitor his or her heart rate, body temperature and estimated expended calories.

The Auto Comm and Source Scanning application 207 automatically attempts to connect the user to the selected communication and media source. The Voice IP and Phone Manager 208 allows the user to take and initiate phone calls via either a voice IP service or via a smartphone Bluetooth connection. The Sys Manager and Remote Desktop application 209 allows the user to setup the listening device from a computer or smartphone that is running the master version of the Sys Manager and Remote Desktop application. All system settings may be configured using this software application including the network IP addresses of the listening device, hotspots, the auto scanning priority list, system security settings, online music service login credentials, plus configuring the other applications' settings including the media playback modes of the DSP, EQ and surround sound virtualization app 210.

The Libraries and Drivers section includes the system Settings 211, the WIFI, Bluetooth, NFC and Ethernet drivers, the HDMI, USB and SD memory drivers 213 plus the driver that controls the keypad and touch display panel 214. In addition, this section has drivers that manages the system security and media digital rights management, or DRM 215, that may be used to play copyright-protected media, as well as the associated CODECS 216 that are used to play encoded media and the DLNA and UPNP 217 drivers. The System API 218 or Application Programming Interface is a set of commands and drivers that allows developers a method to develop custom listening device apps. The Operating System section includes the operating system kernel 219, the system BIOS 220 or Basic IO System, plus any custom firmware 221 or custom drivers 222.

Figure 5:
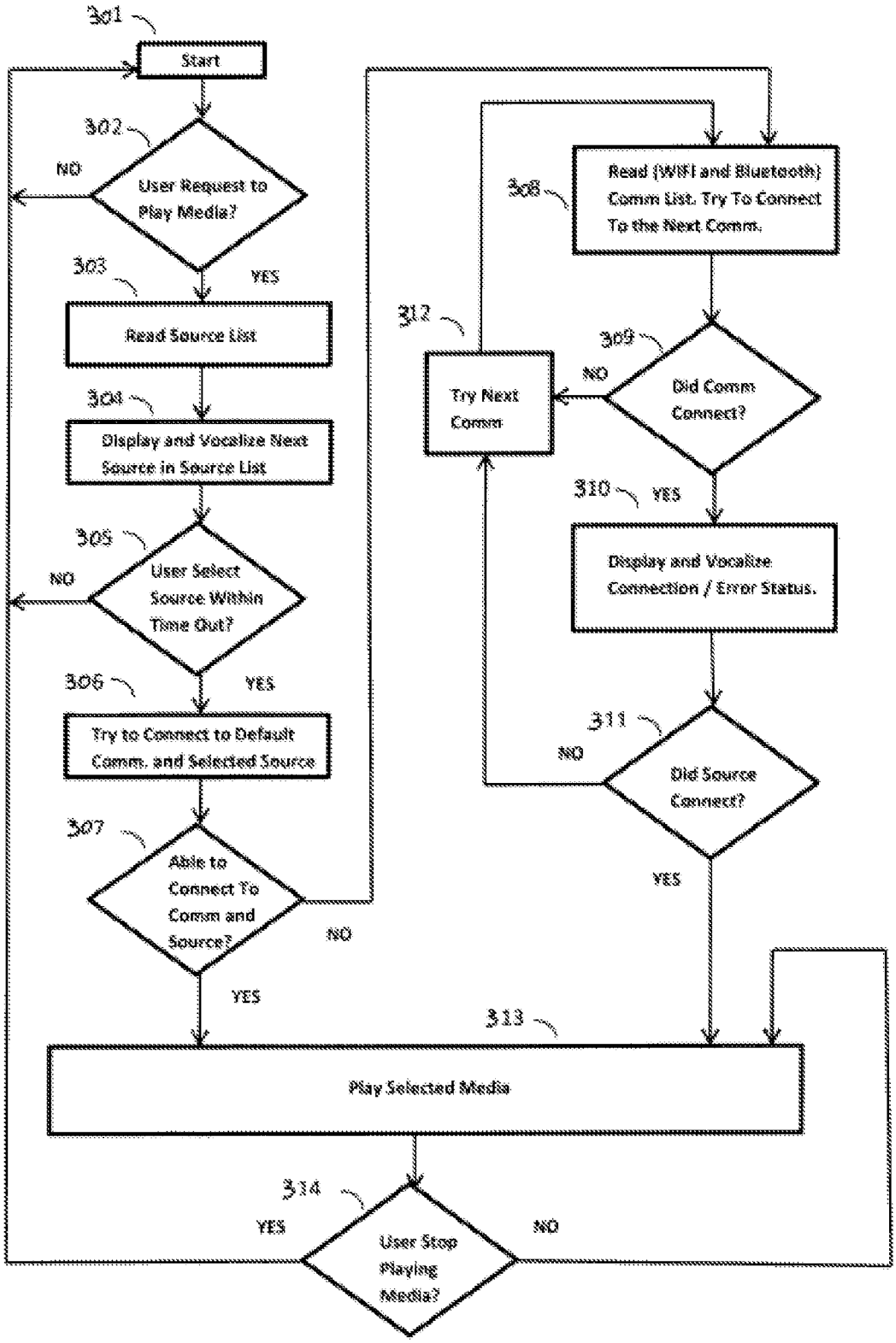
FIG. 5 is a flow diagram depicting the logic flow of the automatic communication and audio source scanning software aspects of the disclosure.

FIG. 5 illustrates in further detail the logical flow of the automatic communication and audio source scanning software utility that automatically attempts to connect the listening device to the selected audio source and the associated communication interface. Upon startup 301, the utility waits for the user to request 3022 to play some media. The media can be a number of different forms of media including locally stored music, an online music streaming music service, an audio source from a home entertainment player such as a game console or TV receiver. The user can request to play a media source using several methods including manually pressing the keypad of the listening device or touch display panel, vocally requesting a source or requesting the source using a remote control application running on a smartphone or other control system. When the user requests to play a media source, the utility reads the source list 303. The source list is predefined by the user when the listening device is setup and configured by selecting what sources of media are available to play and the preferred priority of communication methods that should be used. The communication methods include one or more WIFI access points or "hotspots" and Bluetooth devices.

The utility displays and vocalizes the next available source 304. If the user selects 305 this source, then the utility will try to connect to the source using the default communication source 306. If the utility is able to connect to the communication and media source, then the utility launches the associated application or media player to play the requested media 313. If the utility is unable to connect to the communication and media source, then the utility will read the communication list 308 and attempt to connect to the next communication source listed. If the utility is unable to connect 309, then it will repeat reading 308 and connecting to the next communication source 312 in the list until it tries all of the communication sources. If it is unable to connect, the utility will display and vocalize the error connection status. If the utility connects to a communication source 311, then the utility launches the associated media application or player and plays the selected media 313. The utility returns to the start of the routine once the media is stopped 314.

Figure 6:
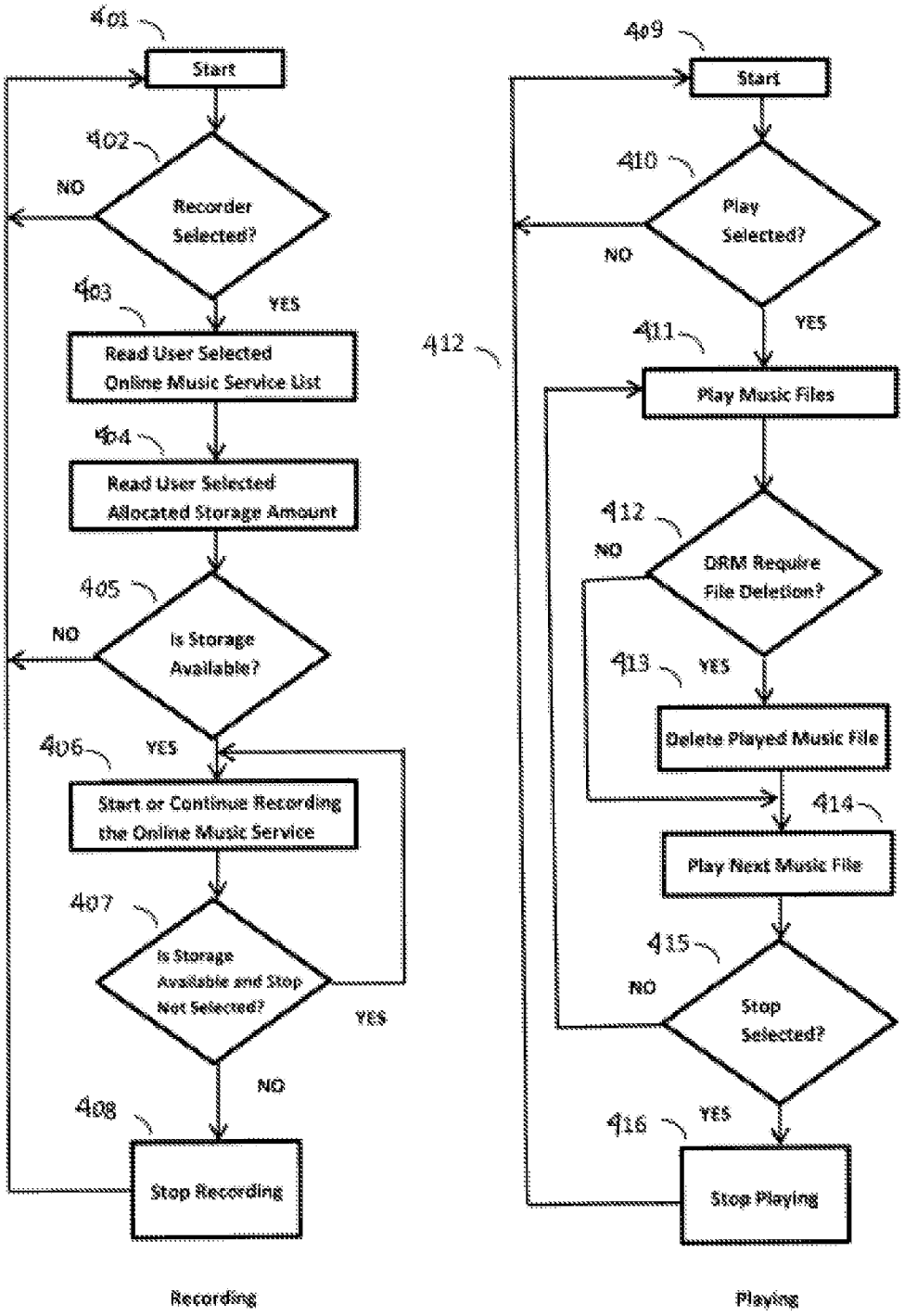
FIG. 6 is a flow diagram depicting automatic online streaming music recording and Digital Rights Management (DRM) software application utility.

FIG. 6 illustrates in further detail the logical flow of the automatic online streaming music recording and Digital Rights Management (DRM) software application utility. The purpose of the online streaming music recording utility is to provide a means for automatically recording music from an online music service which allows subscribers to shift ahead the time when the user may listen to the purchased music. This utility is especially useful for mobile users of the listening device since they may want to listen to their subscribed online streaming music when they are no longer in WIFI or cellular range and are unable to access the online music streaming service. The online streaming music recording utility includes a DRM facility that can be setup to meet the requirements of online music services that require deletion of recorded music after the music has been played.

Upon startup 401, the utility waits for the user to begin to record from an online music service 402. The utility reads the user settings 403 to determine which online music service to record from and the amount of file storage allocated by the user to record 404. The utility determines if there is storage available to begin or continue recording 405. If there is no storage available, the utility does not begin recording 405. If there is storage available, the utility begins to record or continues to record from the online music service 406.

The software continuously monitors the available storage 407 and if there is storage available, it continues to record. If there is no longer available storage, the recording stops 408 and returns to the start 401 of the routine. After starting up the play and DRM routine of the utility 409, and when the user selects to play the recorded music 410, the system begins to play the recorded music 411. The system checks the DRM settings 412 for the specific online music service requirements and if the service requires file deletion, then after each file is played the utility deletes the file 413. If the service does not require file deletion, the music is not deleted and the next music file is played 414. The system checks to see if the user stops the playback 415, and if the user has not stopped playback, the player continues to play the recorded music until the user elects to stops playback 416.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and right", "front" and "rear", "above" and "below" and the like are used as words of convenience to provide reference points and are not to be construed as limiting terms.

In addition, the foregoing describes only some embodiments of the inventions, and alterations, modifications, additions and/or changes can be made thereto without departing from the scope and spirit of the disclosed embodiments, the embodiments being illustrative and not restrictive.

Furthermore, inventions have described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the inventions. Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. A head-supportable audio player and listening device comprising:

two housings structured to be supportable on or about a portion of a user's head, each housing being structured for positioning relative to the user's ears to transmit audio to the auditory canals of the user;

a linking device attached to each of said two housings structured to link one housing to the other housing;

at least one speaker positioned within each of said two housings, said at least one speaker being configured to provide one of or both stereo sound or high definition surround sound audio; and a user-programmable electronics system assembly positioned on one or both of said housings or on said linking device, further comprising:

one or more wireless interfaces configured to provide wireless connectivity of the listening device to wireless-emitting sources; and a voice recognition and synthesis system which provides the ability to vocally search, select for audio files from wired and wireless sources and to control the playback of media, and to program the listening device as an autonomous function of the resident user-programmable electronics system.

2. The head-supportable audio player of claim 1, wherein said at least one speaker further comprises a plurality of speakers located in each of said two housings.

3. The head-supportable audio player of claim 1, further comprising a media storage device.

4. The head-supportable audio player of claim 3, wherein the media storage device further comprises a media buffering device.

5. The head-supportable audio player of claim 1, further comprising a media buffering device.

6. The head-supportable audio player of claim 1, wherein said user-programmable electronics system further comprises voice control of the at least one speaker.

7. The head-supportable audio player of claim 1, further comprising a display apparatus and having one or the other of a keypad or touch screen in communication with the display apparatus.

8. A head-supportable audio player and listening device comprising:

two housings structured to be supportable on or about a portion of a user's head, each housing being structured for positioning relative to the user's ears to transmit audio to the auditory canals of the user;

a linking device attached to each of said two housings structured to link one housing to the other housing;

at least one speaker positioned within each of said two housings, said at least one speaker being configured to provide one of or both stereo sound or high definition surround sound audio; and a user-programmable electronics system assembly positioned on one or both of said housings or on said linking device, further comprising:

automatic scanning capability for selective accessing of audio signals or files from multiple wired and wireless audio sources, including analog and digital devices, via high definition multimedia interfaces, digital media interfaces and pre-amp analog sources;

one or more wireless interfaces configured to provide wireless connectivity of the listening device to wireless-emitting sources;

a media storage device configured to provide in-residence acquisition and storage of user-selected digital files for accessing by and from said listening device; and having programmable functions providing the user with control of said speakers, wireless interfaces and said in-residence audio media storage device.

9. The head-supportable audio player of claim 8, wherein said at least one speaker further comprises a plurality of speakers located in each of said two housings.

* * * * *